United States Patent [19]

Matsuda et al.

[11] 4,119,465

[45] Oct. 10, 1978

[54] DIAZO COPYING MATERIAL FOR SECONDARY ORIGINAL

[75] Inventors: Tsutomu Matsuda; Takeshi Maeda; Takeo Hirabayashi; Nobuyoshi Watanabe, all of Tokyo, Japan

[73] Assignee: Ricoh Co., Ltd., Tokyo, Japan

[21] Appl. No.: 793,779

[22] Filed: May 4, 1977

[30] Foreign Application Priority Data

May 13, 1976 [JP] Japan ..... 51/54626

[51] Int. Cl.[2] ..... G03C 1/38; G03C 1/52

[52] U.S. Cl. ..... 96/75; 96/91 R; 96/114.5; 427/146; 427/150; 427/261; 428/207; 428/325; 428/331; 428/913

[58] Field of Search ..... 427/146, 150, 151, 261; 428/207, 325, 331, 913; 96/75, 114.5, 91 R

[56] References Cited

U.S. PATENT DOCUMENTS

| | | | |
|---|---|---|---|
| 3,948,663 | 4/1976 | Shiba et al. | 96/114.5 X |
| 3,950,171 | 4/1976 | Nihyakumen et al. | 96/75 X |
| 3,963,499 | 6/1976 | Shiba et al. | 96/114.5 X |
| 4,020,261 | 4/1977 | Oda et al. | 427/150 X |

FOREIGN PATENT DOCUMENTS

| | | | |
|---|---|---|---|
| 841,131 | 7/1960 | United Kingdom | 96/75 |

*Primary Examiner*—Thomas J. Herbert, Jr.
*Attorney, Agent, or Firm*—Blanchard, Flynn, Thiel, Boutell & Tanis

[57] ABSTRACT

A method of manufacturing a diazo copying material for use in preparing a secondary original, which comprises coating a water-dispersible precoating liquid comprising a porous powder, a binding agent and an anionic surface active agent having the following general formula on a transparent or translucent support and drying thereafter, and subsequently coating a photosensitive liquid consisting essentially of a photosensitive diazonium salt on the precoated surface of said support and drying thereafter.

general formula:

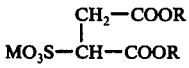

[wherein m represents Na or K, and R represents alkyl radical having 1 - 20 carbon atoms]

8 Claims, No Drawings

DIAZO COPYING MATERIAL FOR SECONDARY ORIGINAL

BACKGROUND OF THE INVENTION (a) Field of the Invention

The present invention relates to a method of manufacturing a diazo copying material suitable for use in preparing a secondary original.

(b) Description of the Prior Art

The so-called secondary original is an original obtained by copying a primary original for the purpose of providing a substitute for said primary original. The secondary original is generally formed on a diazo copying material consisting of a transparent of translucent paper support or plastic film provided with a precoating layer and a photosensitive layer formed thereon.

Accordingly, an image formed on said secondary original is desirably one with the least possible ultraviolet-ray transmission, to wit, a superior light-shielding property, and at the same time, it is desirably one with a color tone easy to see as far as possible, to wit, the highest possible visual density, for the sake of facilitating later entry in the secondary original as occasion demands. Besides, inasmuch as the diazo copying process is the most inexpensive one among varieties of copying processes, in order to make the most of this characteristic, it is to be desired to provide an inexpensive diazo copying material for use in preparing a secondary original.

However, a paper support for a secondary original, which support is processed for transparency or transluceny, tends to be deprived of the surface porousness inherent in paper and a plastic film is high in the smoothness of the surface thereof so that uniform coating of a water-dispersible liquid comprising a porous powder and a binding agent as principal ingredients thereof on such supports, which is generally adopted as a means of forming a high density image on a diazo photosensitive paper, has hitherto been difficult to practice, and unevenness of the coating would take place. Consequently, it is infeasible to obtain a uniform, clear-cut image even when a photosensitive layer is further provided on the precoating layer.

In the prior art, therefore, an organic solvent-type dispersion comprising a porous powder and a binding agent has been applied as a precoating liquid onto a paper support. This conventional method, however, is defective in that safety during the stage of manufacture is not ensured, the resulting secondary original is costly, and, even though there can admittedly be obtained an image with high density to some extent in the case of a dry developing process employing ammonia gas as the developer because of infiltration of said ammonia gas in the binding agent, in the case of the wet developing process employing an aqueous solution of an alkali or a coupler as a developer and the semi-dry developing process employing an organic solvent containing an alkali or a coupler as liquid developer, infiltration and diffusion of the developer becomes insufficient and there can be obtained no more than an image having low density.

SUMMARY OF THE INVENTION

The inventors of the present invention have carried out a series of examinations with a view to developing a means of uniformly applying an aqueous dispersion containing porous powder and binding agent as principal ingredients thereof onto a transparent or translucent paper support or plastic film to form a precoating layer thereon, and they have come to a finding that the foregoing object can be attained by making said aqueous dispersion contain a specific anionic surface active agent. The present invention has been accomplished on the basis of this finding.

In other words, the present invention provides a method of manufacturing a diazo copying material suitable for use in preparing a secondary original, which method comprises coating a water-dispersible precoating liquid comprising a porous powder, a binding resin and an anionic surface active agent expressed by the following general formula on a transparent or translucent support and drying thereafter, and subsequently coating a photosensitive liquid consisting essentially of a photosensitive diazonium salt on the precoated surface of said support and drying thereafter.

general formula:

$$\begin{array}{l} \quad\quad\quad CH_2{-}COOR \\ \quad\quad\quad\quad | \\ MO_3S{-}CH{-}COOR \end{array}$$

[wherein M represents Na or K, and R represents alkyl radical having 1–20 carbon atoms]

In the present invention, said anionic surface active agent is one expressed by the foregoing general formula, and especially R therein is preferably alkyl radical having 8–16 carbon atoms. To be more concrete, the anionic surface active agent is particularly effective in the case where R is $C_{12}H_{25}$ and X is Na, the case where R is $C_{14}H_{29}$ and X is Na, and the case where R is $C_{10}H_{21}$ and X is K in said general formula.

The anionic surface active agents according to the foregoing general formula can be used either independently or upon admixing. The anionic surface active agent thus applied constitutes a water-dispersible precoating liquid together with a porous powder and a binding agent, and the appropriate amount of the anionic surface active agent to be applied is in the range of 0.01–1.0 wt.% of the whole amount of precoating liquid. As the applicable porous powder, silica, alumina, clay, starch, synthetic high molecular powder, etc. can be cited, and the appropriate amount of such a porous powder is in the range of 0.1–20 wt.% of the whole amount of precoating liquid.

The applicable binding agents include water-soluble high molecular substances such as polyvinyl alcohol, polyacrylamide, polyvinyl pyrrolidone, methyl cellulose, ethyl cellulose, carboxymethyl cellulose, carboxyethyl cellulose, gelatin, gum arabic, casein, soluble starch, etc. as well as emulsion-type resins such as polyvinyl acetate emulsion, styrene-butadiene copolymer emulsion, polyvinyl chloride emulsion, etc. The appropriate amount of the binding agent to be applied is in the range of 0.1–5 parts by weight as solid content relative to 1 part by weight of the porous powder. Further, to the precoating liquid is added a dye for the ground such as Methylene Blue (C.I. No. 52015), Methyl Violet (C.I. No. 42535), etc. in the amount of 0.01–0.1 wt.%.

The precoating liquid comprising the foregoing ingredients is applied onto a transparent or translucent paper support or plastic film in a prescribed amount with a wire bar, etc. like in the case of the conventional method.

The precoating liquid in the present invention can be uniformly coated on the transparent or translucent supports useful as the support for the conventional diazo copying materials for secondary originals, such as transparent paper obtained through resin treatment, tracing paper, rag paper, parchment paper, synthetic paper, plastic film like polyester film, acetyl cellulose film, etc.

In the present invention, on the precoating layer is further formed a photosensitive layer, and as for the photosensitive liquid per se to form this photosensitive layer, any conventional, well-known photosensitive liquid can be applied without being restricted by the precoating liquid peculiar to the present invention.

According to the above described method in the present invention, inasmuch as a precoating layer can be formed very easily, inexpensively and uniformly on a transparent or translucent paper support or plastic film, a diazo-type secondary original with high visual density of image can be prepared economically, and the diazo copying material for preparing a secondary original under the present invention is versatile and applicable to any of the wet, dry and semi-dry copying processes. Therefore, it is possible to accelerate the printing speed by the use of a diazo compound of high concentration.

DESCRIPTION OF THE PREFERRED EMBODIMENTS

EXAMPLE 1.

A precoating liquid having the following composition was coated on a transparent paper obtained through resin treatment (weighing 50 g/m$^2$) by means of a wire bar and then was dried (the amount of adhering precoating liquid in dry weight: 3.8 g/m$^2$).

| | |
|---|---|
| pulverized silica (mean grain size: 1μ) | 30 g |
| polyvinyl acetate emulsion (solid content: 40%, molecular weight: 3000) | 80 g |
| corn starch | 10 g |
| $NaO_3S-\underset{\displaystyle CH_2-COOC_{12}H_{25}}{\underset{\vert}{CH}}-COOC_{12}H_{25}$ (anionic surface active agent) | 1 g |
| Methylene Blue | 0.1 g |
| water | an amount to make the whole quantity of liquid 1l. |

The thus precoated paper was next coated with a photosensitive liquid having the following composition by means of a glass doctor and then was dried (the amount of adhering photosensitive liquid in dry weight: 1 g/m$^2$).

| | |
|---|---|
| isopropyl alcohol | 30 g |
| ethylene glycol | 50 g |
| citric acid | 30 g |
| caffeine | 10 g |
| resorcine | 20 g |
| 4-morpholino-2,5-diethoxybenzene diazonium chloride . ½ $ZnCl_2$ | 20 g |
| saponin | 1 g |

When an appropriate original was laid on the copying material for secondary original prepared through the foregoing process and development was effected by the use of a commercial dry, wet, and semi-dry copying machine, respectively, there was obtained a secondary original with high density of image showing a sepia color tone with good uniformity, respectively.

On the other hand, when a diazo copying material for secondary original for the purpose of comparison was prepared by applying a precoating liquid having the same composition as that of the precoating liquid employed in the present example save for omitting said anionic surface active agent and development was effected through the same procedure as in the present example, there was observed conspicuous unevenness of coating, and it was impossible to obtain a secondary original with good uniformity (Comparative Example 1). Further, when another diazo copying material for secondary original was prepared by applying a precoating liquid having the same composition as that of the precoating liquid employed in the present example save for substituting toluene for water as solvent and development was effected through the same procedure as in the present example, the image of the resulting secondary original was low density even though it was admittedly free of unevenness of coating (Comparative Example 2). The concrete results were as shown in the following table.

| | Precoating liquid | | Uniformity of image | Density of image | | |
|---|---|---|---|---|---|---|
| | surface active agent | solvent | | dry developing | wet developing | semi-dry developing |
| Example 1 | employed | water | O | 1.67 | 1.59 | 1.24 |
| Comparative Example 1 | not employed | water | X | — | — | — |
| Comparative Example 2 | employed | toluene | O | 1.24 | 0.72 | 0.53 |

(Remark)
The density of image was measured with Macbeth's Densitometer (the manufacture of MACBETH Co., U.S.A.)

EXAMPLE 2.

A precoating liquid having the same composition as that in Example 1 was coated on a tracing paper (weighing 60 g/m$^2$) by means of a wire bar and then was dried (the amount of adhering precoating liquid in dry weight: 2.8 g/m$^2$).

The thus precoated paper was next coated with a photosensitive liquid having the same composition as that in Example 1 by means of a glass doctor and then was dried (the amount of adhering photosensitive liquid in dry weight: 1 g/m$^2$).

When the thus prepared diazo copying material for secondary original was exposed and developed through the same procedure as in Example 1, there was obtained a secondary original with high density of image showing a sepia color tone with good uniformity, respectively. The concentration of image was 1.63 in the case of the dry developing process, 1.55 in the case of the wet developing process and 1.19 in the case of the semi-dry developing process.

EXAMPLE 3

A precoating liquid having the following composition was coated on a rag paper (weighing 68 g/m$^2$) by means of a wire bar and then was dried (the amount of adhering precoating liquid in dry weight: 3.5 g/m$^2$).

| | |
|---|---|
| pulverized silica (mean grain size: 1μ) | 60 g |
| polyvinyl acetate emulsion (solid content: 40%, molecular weight: 3000) | 30 g |
| rice starch | 10 g |
| $NaO_3S-\underset{\displaystyle CH_2-COOC_{14}H_{29}}{\underset{\vert}{CH}}-COOC_{14}H_{29}$ (anionic surface active agent) | 1.5 g |
| Patent Pure Blue (C.I. No. 42045) | 0.1 g |
| water | an amount to make |

-continued

| | |
|---|---|
| | the whole quantity of liquid 11 |

The thus precoated paper was next coated with a photosensitive liquid having the following composition by means of a glass doctor and then was dried (the amount of adhering photosensitive liquid in dry weight: 0.8 g/m$^2$).

| | |
|---|---|
| isopropyl alcohol | 30 g |
| tartaric acid | 40 g |
| monoethanolamide of resorcinol-4-carboxylic acid | 15 g |
| 4-morpholino-2,5-dibutoxybenzene diazonium chloride . ½ $ZnCl_2$ | 25 g |
| saponin | 1 g |

When the thus prepared diazo copying material for secondary original was exposed and developed through the same procedure as in Example 1, there was obtained a secondary original with high density of image showing a sepia color tone with good uniformity, respectively. The density of image was 1.47 in the case of the dry developing process, 1.52 in the case of the wet developing process and 1.25 in the case of the semi-dry developing process.

EXAMPLE 4.

A precoating liquid having the same composition as that in Example 3 was coated on a parchment paper (weighing 65 g/m$^2$) by means of a wire bar and then was dried (the amount of adhering precoating liquid in dry weight: 2.9 g/m$^2$).

The thus precoated paper was next coated with a photosensitive liquid having the following composition by means of a glass doctor and then was dried (the amount of adhering photosensitive liquid in dry weight: 0.9 g/m$^2$).

| | |
|---|---|
| diethylene glycol | 30 g |
| boric acid | 10 g |
| sulfuric acid | 1 g |
| monomethyl ester of resorcinol-4-carboxylic acid | 15 g |
| 4-acetyl piperadino-2,5-diamyloxybenzene diazonium chloride . bisulfate | 25 g |
| saponin | 2 g |

When the thus prepared diazo copying material for secondary original was exposed and developed through the same procedure as in Example 1, there was obtained a secondary original with high density of image showing a sepia color tone with good uniformity, respectively. The density of image was 1.50 in the case of the dry developing process, 1.49 in the case of the wet developing process and 1.18 in the case of the semi-dry developing process.

EXAMPLE 5.

By coating a transparent paper obtained through resin treatment (weighing 65 g/m$^2$) with a precoating liquid having the same composition as that in Example 1 save for substituting 0.5 g of $$NaO_3S-\underset{}{\overset{CH_2-COOC_{10}H_{21}}{\overset{|}{CH}}}-COOC_{10}H_{21}$$

for the anionic surface active agent used in Example 1, a diazo copying material for secondary original was prepared. When this diazo copying material was exposed and developed through the same procedure as in Example 1, there was obtained a secondary original with high density of image showing a sepia color tone with good uniformity, respectively. The density of image was 1.52 in the case of the dry developing process, 1.48 in the case of the wet developing process and 1.20 in the case of the semi-dry developing process.

What is claimed is:

1. A method of manufacturing a diazo copying material for use in preparing a secondary original, which comprises the steps of coating onto a transparent or translucent support a dispersion in water of a composition consisting essentially of (a) from 0.01 to 1.0 wt.%, based on the weight of said dispersion, of one or a mixture of anionic surface active agents having the formula $$MO_3S-\overset{CH_2-COOR}{\overset{|}{CH}}-COOR$$

wherein M is Na or K, and R is alkyl having 1 to 20 carbons, (b) from 0.1 to 20 wt.%, based on the weight of said dispersion, of a powder, and (c) from 0.1 to 5 parts by weight, per 1 part by weight of (b), of a binding agent, and then drying said dispersion to form a precoating layer on said support, then coating a photosensitive liquid containing a photosensitive diazonium salt onto said precoating layer and then drying said liquid to form a photosensitive layer on said precoating layer.

2. A method according to claim 1, wherein R is alkyl having 8–16 carbon atoms.

3. A method according to claim 1, wherein R is alkyl having 12 carbon atoms and M is Na.

4. A method according to claim 1, wherein R is alkyl having 14 carbon atoms and M is Na.

5. A method according to claim 1, wherein R is alkyl having 10 carbon atoms and M is K.

6. A method according to claim 1 in which said powder is a powder of a material selected from the group consisting of silica, alumina, clay, starch and synthetic high molecular material.

7. A method according to claim 6 in which said binding agent is selected from the group consisting of polyvinyl alcohol, polyacrylamide, polyvinylpyrrolidone, methyl cellulose, ethyl cellulose, carboxymethyl cellulose, carboxyethyl cellulose, gelatin, gum arabic, casein, soluble starch, polyvinyl acetate, styrenebutadiene copolymer and polyvinyl chloride.

8. A method according to claim 7 in which said dispersion contains from 0.01 to 0.1 wt.% of a dye.

* * * * *